United States Patent [19]

Ishii et al.

[11] Patent Number: 4,693,619

[45] Date of Patent: Sep. 15, 1987

[54] STEPPING MOTOR OPERATED POSITIONING DEVICE FOR A RIBBON LIFTER IN A PRINTER

[75] Inventors: Hidekazu Ishii; Chihiro Kosaka, both of Shizuoka, Japan

[73] Assignee: Tokyo Electric Co., Ltd., Tokyo, Japan

[21] Appl. No.: 790,502

[22] Filed: Oct. 23, 1985

[30] Foreign Application Priority Data

Oct. 26, 1984 [JP] Japan ..... 59-225536

[51] Int. Cl.[4] ..... B41J 35/14

[52] U.S. Cl. ..... 400/212; 400/216.1; 400/229

[58] Field of Search ..... 400/211, 212, 213, 213.1, 400/216, 216.1, 216.2, 225, 229, 236, 236.2, 322, 697, 697.1, 902, 903, 163; 192/54, 55, 56 R; 318/696

[56] References Cited

U.S. PATENT DOCUMENTS 4,122,827 10/1978 Rhodes ..... 74/3.5
4,329,072 5/1982 Kacmarcik ..... 400/212

FOREIGN PATENT DOCUMENTS 2306836 11/1976 France ..... 400/216.1
78883 5/1984 Japan ..... 400/212
176085 10/1984 Japan ..... 400/216.1

OTHER PUBLICATIONS

F. J. Burchett et al; "Misalignment Correction for Ribbon Lift Mechanism"; *IBM Technical Disclosure Bulletin;* vol. 26, No. 3A, pp. 1159–1160; Aug. 1983.

*Primary Examiner*—Edgar S. Burr
*Assistant Examiner*—David A. Wiecking
*Attorney, Agent, or Firm*—Oblon, Fisher, Spivak, McClelland & Maier

[57] ABSTRACT

A positioning device for a printer for driving a ribbon base on which a ribbon cassette is carried by means of a stepping motor to position a ribbon to any of predetermined shift positions. The device includes a stopper for defining a home position of the ribbon cassette, and a power transmitting mechanism for transmitting a power of the stepping motor to the ribbon base. The power transmitting mechanism includes therein a torque limiter which yields a slip therein when a torque lower than a pull-out torque of the stepping motor is applied thereto. Accordingly, when the ribbon cassette is abutted with the stopper, the stepping motor is allowed to continue rotation thereof without stepping out by the torque limiter, thereby preventing an out-of-phase condition of the stepping motor at a stopped position thereof. Consequently, upon subsequent operation, the ribbon cassette can be shifted accurately, and hence color mixture in printing can be eliminated.

1 Claim, 5 Drawing Figures

STEPPING MOTOR OPERATED POSITIONING DEVICE FOR A RIBBON LIFTER IN A PRINTER

FIELD OF THE INVENTION

This invention relates to a positioning device for a printer, and more particularly to a positioning device for a printer which can position any of various structural components of the printer such as a carriage and a multi-color print ribbon which is colored in a plurality of zones along the length thereof.

BACKGROUND OF THE INVENTION

An exemplary one of conventional ribbon shifting devices will now be described with reference to FIG. 5. A ribbon base 3 is mounted for pivotal motion by means of a support shaft 4 on a carriage 2 which is mounted for reciprocal motion along a platen 1. A stepping motor 5 and gear wheels 6, 7 and 8 connected to be driven in series by the motor 5 are carried on the carriage 2, and a sector gear 9 is secured to the ribbon base 3 and is meshed with the gear wheel 8 so that rotation of the stepping motor 5 may be transmitted via the gear wheels 6, 7 and 8 to the sector gear 9 to pivot the ribbon base 3 in a vertical direction perpendicular to the platen 1 together with a ribbon cassette 10 for a multi-color ribbon thereby to position the ribbon to oppose a portion of the ribbon for a desired color to the platen.

Meanwhile, where the ribbon has up to four color zones, if the width of the ribbon is 19 mm, then the width of each color zone becomes 4.75 mm. The height of a character is normally 3.2 and 4.1 mm, and where it is 4.1 mm, each color zone includes a margin only of 0.325 mm at each of opposite marginal ridges thereof. Accordingly, if the ribbon is mispositioned in a vertical direction, color mixture may occur, that is, a character may be printed partly in a different color in error. In order to prevent such mispositioning, a stopper 11 is mounted on the carriage 2 such that it may abut with the ribbon base 3 to provide a reference position for the ribbon cassette 10 while predetermined pulses are applied to the stepping motor 5 thereby to define a range of movement of the ribbon base 3 to control a shift position of the ribbon relative to the platen.

However, if the ribbon base 3 is abutted with the stopper 11 during movement of the ribbon base 3 to the reference position, the stepping motor 5 will step out since pulses are still being applied to the stepping motor 5. Accordingly, if a predetermined number of pulses are applied to drive the stepping motor 5 after the stepping motor 5 has been stopped, the stepping motor 5 will not be regulated for a difference in phase which has been caused upon such stepping out thereof, and hence color mixture in printing may occur. This problem can be eliminated if a phase of the stepping motor 5 upon stepping out is detected and is fed back to a control circuit to correct pulses to be inputted to the stepping motor 5. However, such means will raise the production cost of the device very much and hence is disadvantageous in practical use.

With such circumstances taken into consideration, normally the stepping motor 5 and the gear wheels 6, 7 and 8 and the sector gear 9 are assembled while the stepping motor 5 is held energized in a predetermined phase with the position of the ribbon base 3 adjusted by the stopper 11. However, such means has a drawback that it will render assembling operations troublesome and increase man-hours, resulting in increase in production costs.

OBJECT OF THE INVENTION

The present invention has been made in consideration of such circumstances, and it is an object of the invention to provide a positioning device for a printer which is facilitated in adjusting operations thereof and can be produced at a reduced cost.

SUMMARY OF THE INVENTION

According to the present invention, there is provided a positioning device for a printer which comprises a movable member mounted for pivotal motion, an adjustable stopper disposed for abutting with the movable member, and a power transmitting mechanism for transmitting a power of a stepping motor to the movable member, the power transmitting mechanism including atorque limiter which yields a slip therein when a torque lower than an output power (that is, a pull-out torque) of the stepping motor is applied thereto.

For example, description will now be given of a condition wherein the invention is applied to a ribbon shifting device. Referring to FIG. 1, a ribbon base 3 for holding a ribbon cassette 10 thereon is mounted on a carriage 2 for pivotal motion in a vertical direction perpendicular to a platen 1. An adjustable screw stopper 15 is mounted for adjustment on the carriage 2 and is disposed for abutment with the ribbon base 3. A stepping motor 5 is mounted on the carriage 2, and a power transmitting mechanism 17 for transmitting a power of the stepping motor 5 to the ribbon base 3 is provided. The power transmitting mechanism 17 includes a torque limiter 18 which yields a slip when a torque lower than an output power (that is, a pull-out torque) of the stepping motor 5 is applied thereto.

Accordingly, if pulses are inputted to the stepping motor 5 so as to rotate the same by a predetermined number of steps to move the ribbon base 3 from a current position sufficiently until the ribbon base 3 is abutted, during such rotation of the stepping motor 5, with the adjustable screw stopper 15 at stop the ribbon cassette 10 to a reference position, the torque limiter 18 will yield a slip therein, thereby allowing the stepping motor 5 to be stopped without stepping out. The phase of the stepping motor 5 when it is stopped remains as specified previously, and hence if the stepping motor 5 is driven by a number of steps corresponding to a distance over which the ribbon base 3 is to be moved with the phase taken as a reference, the ribbon cassette 10 can be accurately and easily positioned relative to the platen 1.

DETAILED DESCRIPTION OF THE PREFERRED EMBODIMENT

Figure 5:
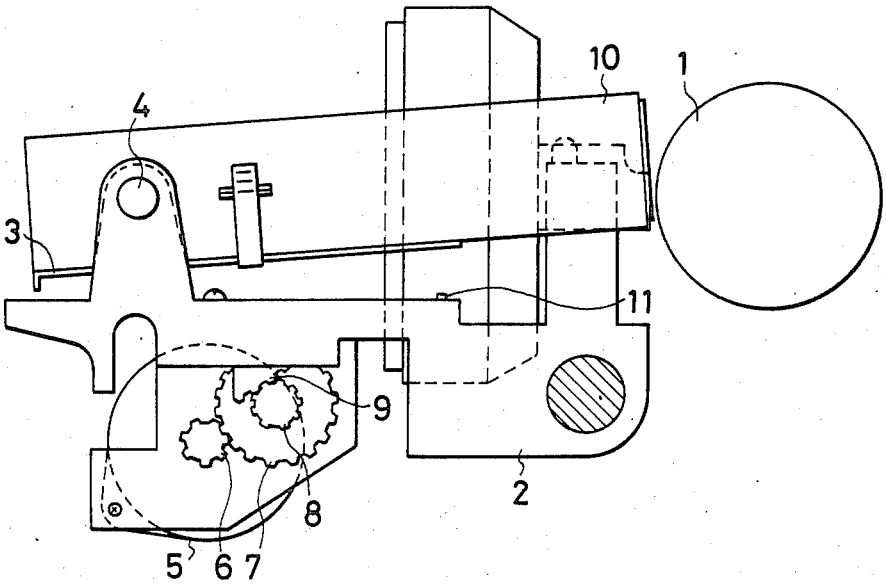
FIG. 5 PRIOR ART
FIG. 5 is a side elevational view of a conventional positioning device for a printer.

A preferred embodiment of the present invention will now be described with reference to FIGS. 1 to 4. In these figures, like reference numerals designate like parts or components to those of the device of FIG. 5. A pair of guide shafts 12 and 13 extend in parallel relationship to a platen 1, and a carriage 2 is mounted for sliding movement on the guide shafts 12 and 13. A print head 14 constituting a printing means is carried on the carriage 2, and a ribbon base 3 acting as a movable member is mounted for up and down pivotal motion on the carriage 2 by means of a support shaft 4. An adjustable screw stopper 15 is threaded into the carriage 2. A clamp 126 for removably holding a ribbon cassette 10 thereon is mounted on the ribbon base 3, and a sector gear 9 is mounted on the ribbon base 3 for pivotal motion around the support shaft 4.

Meanwhile, a stepping motor 5 and gear wheels 6, 7 and 8 for transmitting a power of the stepping motor 5 serially to the sector gear 9 are mounted on the carriage 2. The gear wheels 6, 7 and 8 and the sector gear 9 form a power transmitting mechanism 17. Meanwhile, the gear wheels 7 and 8 form a torque limiter 18. The torque limiter 18 has a predetermined maximum torque to be transmittable thereby. If a torque higher than the maximum torque is applied, the torque limiter 18 will yield a slip therein, and hence only a torque within a predetermined fixed range is transmitted by the torque limiter 18. Concrete structure of the torque limiter 18 will be hereinafter described in detail. Now, if the gear wheel 8 is held from rotation, the gear wheel 7 will rotate while slipping relative to the gear wheel 8, and the torque when such slipping occurs is selected to have a value lower than that of an output power (that is, a pull-out torque) of the stepping motor 5.

The ribbon cassette 10 includes a cassette case 25 in which a ribbon 19 having ink zones 20, 21, 22 and 23 of four different colors thereon is contained. A ribbon feed roller 24 is mounted in the cassette case 25 and positioned to be driven by a ribbon driving shaft (not shown) on the carriage 2. A pair of arms 26 are provided on opposite sides of the cassette case 25 and extend therefrom to positions adjacent opposite sides of an end of the print head 14. A ribbon guide (not shown) is located between ends of the arms 26 for slidably holding the ribbon 19 so as not to become loose in a widthwise direction.

The torque limiter 18 is formed between and by the gear wheels 7 and 8. The gear wheel 8 has a fitting hub portion **8*a* and an opposing flange 8*b* formed thereon, and the gear wheel 7 is fitted for rotation and axial sliding motion on the fitting hub portion 8*a* of the gear wheel 8. The gear wheel 7 also has a friction flange 7*a*, and a metal plate 18*a* is interposed between the opposing flange 8*b* of the gear wheel 8 and the friction flange 7*a* of the gear wheel 7. Another metal plate 18*c* is interposed between an outer face of the friction flange 7*a* of the gear wheel 7 and a conical spring 18*b* the other end of which abuts against an end flange 8*c* of the gear wheel 8. Thus, a torque transmitting force from the gear wheel 7 to the gear wheel 8 is provided by a pressing force of the conical spring 18*b***.

With such a construction as described above, the adjustable screw stopper 15 is adjusted to abut with the bottom face of the ribbon base 3 so that the uppermost ink zone 20 of the ribbon 19 may oppose to a printing position of the platen 1. With this position regarded as a reference position, the ribbon base 3 must necessarily be shifted to three other vertical positions in order to bring the ink zones 21, 22, and 23 selectively to a position opposing to the printing position of the platen 1. If the number of steps of the stepping motor 5 necessary to move the ribbon base 3 a distance between adjacent shift positions is selected to be 10, then the number of steps of the stepping motor 5 necessary to move the ribbon base 3 over a maximum range provided by the shift positions is 30. Accordingly, at any position of the ribbon base 3, if the stepping motor 5 is driven by a number of steps greater than 30 in a direction to bring the ribbon base 3 into abutment with the adjustable screw stopper 15 with a margin taken into consideration, then even after the ribbon base 3 is abutted with the adjustable screw stopper 15, the stepping motor 5 will continue to rotate in response to inputted pulses while the ribbon base 3 will be held in a stopped condition due to a slipping action of the torque limiter 18. Accordingly, the stepping motor 5 will be stopped after rotation by a particular number of steps without causing stepping out thereof. The phase of the stepping motor 5 then remains as specified previously. Accordingly, by inputting pulses corresponding to 10, 20 and 30 steps to drive the stepping motor 5 to move the ribbon base 3 from the reference position, a desired one of the ink zones 20, 21, 22 and 23 can be positioned to oppose to the printing position of the platen 1.

Figure 1:
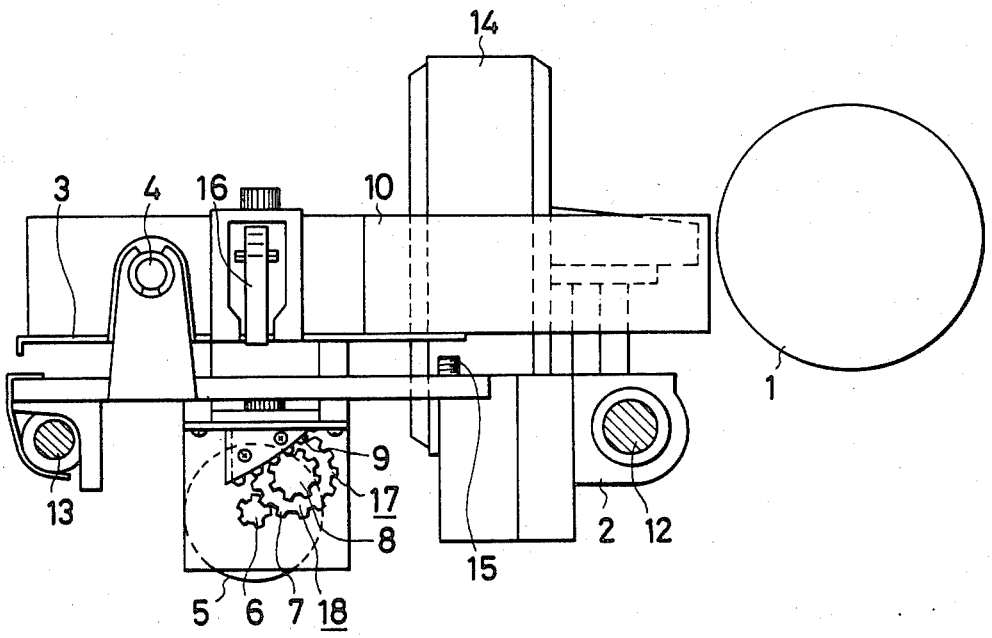
FIG. 1 is a side elevational view of a positioning device for a printer, illustrating a ribbon base lifted from a reference position.
Figure 2:
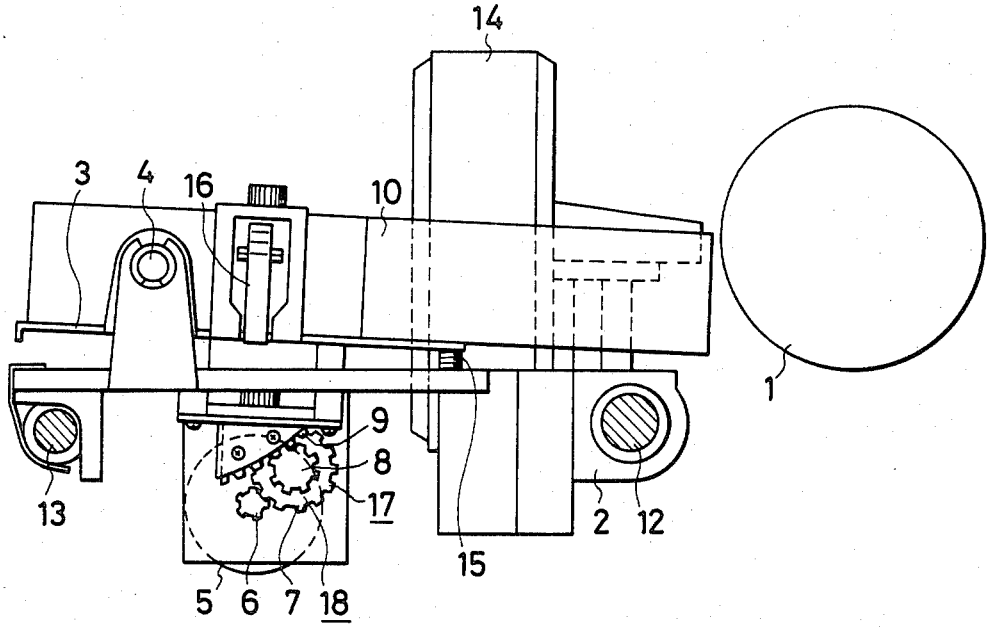
FIG. 2 is a side elevational view illustrating the ribbon base positioned at the reference position.
Figure 3:
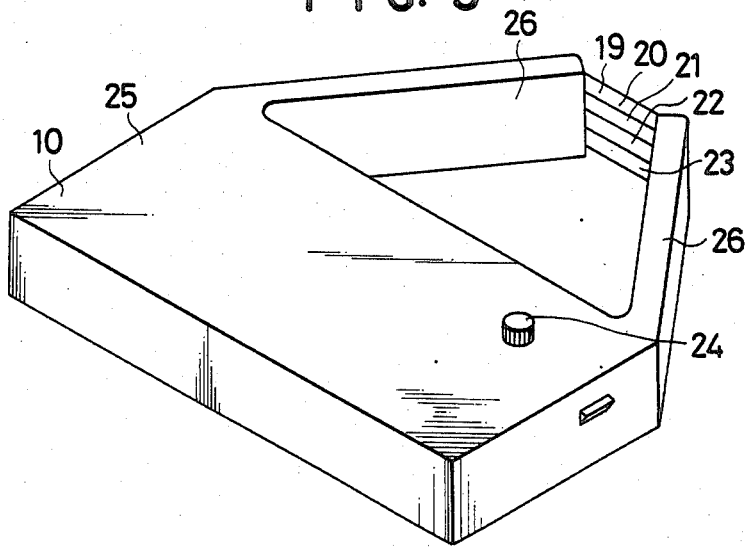
FIG. 3 is a perspective view of a ribbon cassette.
Figure 4:
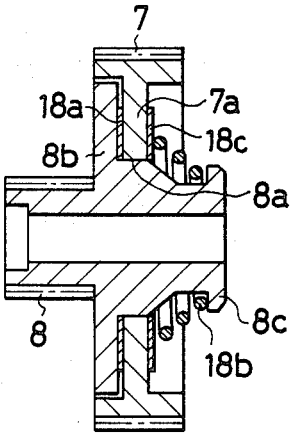
FIG. 4 is a vertical sectional, side elevational view of a torque limiter.

FIG. 2 illustrates the ribbon base 3 positioned at the reference position in which the uppermost ink zone 20 of the ribbon 19 is opposed to the printing position of the platen 1, and FIG. 1 illustrates the ribbon base 3 which has been lifted by a distance corresponding to 10 steps from the position of FIG. 2 to a position in which the second uppermost ink zone 21 is opposed to the printing position of the platen 1.

In this way, the reference position of the ribbon base 3 can be defined very easily, and, after the reference position has been defined, a desired one of the ink zones 20, 21, 22 and 23 can be accurately opposed to the printing position of the platen 1 by suitably controlling the stepping motor 5. As a result, color mixture in printing can be prevented. Besides, if the device is constituted such that the stepping motor 5 is controlled to be held excited after the ribbon base 3 has been moved to a desired one of the shift positions, then a detent mechanism for mechanically positioning the ribbon base 3 can be eliminated

We claim:

1. A printer comprising:

(a) a cylindrical platen having an axis;

(b) at least one guide shaft having an axis parallel to the axis of said cylindrical platen;

(c) a carriage slidably mounted on said at least one guide shaft for movement parallel to the axis of said cylindrical platen;

(d) a ribbon base mounted on said carriage for pivotal movement about an axis parallel to the axis of said cylindrical platen;

(e) an adjustable screw stopper threadably mounted in said carriage and projecting therefrom toward said ribbon base, said adjustable screw stopper being sized and positioned so that contact between said adjustable screw stopper and said ribbon base provides a reference position for said ribbon base relative to said cylindrical platen and so that the point of contact between said adjustable screw stopper and said ribbon base is adjustable by movement of said adjustable screw stopper relative to said carriage;

(f) a stepping motor mounted on said carriage;

(g) a sector gear mounted on said ribbon base, said sector gear being concentric to the axis about which said ribbon base pivots; and (h) a power transmitting mechanism operatively connecting said stepping motor to said sector gear, said power transmitting mechanism comprising a torque limiter designed to slip at a torque less than the maximum torque produceable by said stepping motor, whereby, if in use said ribbon base comes into contact with said adjustable screw stopper before said stepping motor has stepped out, said stepping motor continues to rotate, thereby preventing an out-of-phase condition of said stepping motor.

* * * * *